US005315753A

United States Patent [19]

Jensen et al.

[11] Patent Number: 5,315,753

[45] Date of Patent: May 31, 1994

[54] METHOD OF MANUFACTURE OF HIGH DIELECTRIC ANTENNA STRUCTURE

[75] Inventors: Paul C. Jensen, Broomfield; David W. Paananen, Lafayette, both of Colo.

[73] Assignee: Ball Corporation, Muncie, Ind.

[21] Appl. No.: 13,590

[22] Filed: Feb. 4, 1993

Related U.S. Application Data

[63] Continuation-in-part of Ser. No. 799,264, Nov. 27, 1991, which is a continuation of Ser. No. 551,206, Jul. 11, 1990, abandoned.

[51] Int. Cl.[5] ..... H01P 11/06

[52] U.S. Cl. ..... 29/600; 333/205; 343/700 MS

[58] Field of Search ..... 29/600; 343/700 MS; 333/205

[56] References Cited

U.S. PATENT DOCUMENTS

| | | | |
|---|---|---|---|
| 3,972,049 | 7/1976 | Kaloi | 343/700 MS |
| 4,012,741 | 3/1977 | Johnson | 343/700 |
| 4,070,676 | 1/1978 | Sanford | 343/700 |
| 4,218,682 | 8/1980 | Yu | 343/700 MS |
| 4,259,670 | 3/1981 | Schiavone | 343/700 MS |
| 4,529,987 | 11/1987 | Bhartia et al. | 343/700 MS |
| 4,538,153 | 8/1985 | Taga | 343/700 MS |
| 4,609,892 | 9/1986 | Higgins, Jr. | 29/600 X |
| 4,613,868 | 9/1986 | Weiss | 343/700 |
| 4,660,048 | 11/1987 | Doyle | 343/700 |
| 4,706,050 | 11/1987 | Andrews | 333/205 |
| 4,733,245 | 3/1988 | Mussler | 343/769 |
| 4,791,423 | 12/1988 | Yokoyama et al. | 343/700 MS |
| 4,800,392 | 1/1989 | Garay et al. | 343/700 MS |
| 4,827,271 | 5/1989 | Berneking et al. | 343/700 MS |
| 4,843,400 | 6/1989 | Tsao et al. | 343/700 MS |
| 4,864,314 | 9/1989 | Bond | 343/700 MS |
| 4,933,680 | 6/1990 | Shapiro et al. | 343/700 MS |
| 5,030,962 | 7/1991 | Rees | 343/700 MS |
| 5,039,992 | 8/1991 | Lenormand et al. | 343/708 |
| 5,043,738 | 8/1991 | Shapiro et al. | 343/700 MS |
| 5,075,691 | 12/1991 | Garay et al. | 343/830 |

FOREIGN PATENT DOCUMENTS

| | | | |
|---|---|---|---|
| 0432647A2 | 6/1991 | European Pat. Off. . | |
| 0006503 | 1/1981 | Japan . | |
| 2088407 | 3/1990 | Japan . | |
| 1479983 | 5/1989 | U.S.S.R. | 343/700 MS |
| 2147744 | 5/1985 | United Kingdom . | |

OTHER PUBLICATIONS

Hassani, "Full-Wave Analysis of Stacked Rectangular Microstrip Antennas" 6th International Conference on Antennas and Propagation (ICAP 89), Apr. 89, pp. 369-373.

(List continued on next page.)

*Primary Examiner*—Carl J. Arbes
*Attorney, Agent, or Firm*—Gilbert E. Alberding

[57] ABSTRACT

The present invention discloses a method for manufacturing a high dielectric antenna structure. In one embodiment, one or more high dielectric film layers are applied to a dielectric base layer by silk-screening to yield a dielectric structure having a dielectric constant greater than that of the dielectric base layer. After firing, a patch antenna element having a predetermined configuration is disposed on the top surface of the dielectric structure by silk-screening a conductive paste thereupon and firing. A ground plane is disposed on the bottom surface of the dielectric structure by silk-screening a conductive paste thereupon and firing. A predrilled dielectric base layer may be employed with registered holes defined in the various silk-screened layers to provide access for an RF feed means, or alternatively, a feed hole can be bored through the antenna structure to permit interconnection between an RF feed means and the patch antenna element. For multiple-frequency applications, additional stacked dielectric structures and patch antenna elements can be manufactured according to the disclosed method, with the uppermost patch antenna element being interconnected with the RF feed means.

19 Claims, 4 Drawing Sheets

OTHER PUBLICATIONS

Chap. 7 "Antenna Engineering Handbook", Johnson and Jasik, Eds., 2nd Edition, McGraw-Hill, Inc., Munson, Microstrip Antennas, pp. 7-1-7-28.

NTZ Nachrichtentechnische Zeitschrift, NTZ Communications Journal, vol. 28, No. 5, May 1975, pp. 156-159 by Wiesbeck.

Electronic Letters, vol. 15, No. 15, Jul. 19, 1979, pp. 458-459, by Hall et al.

Ramy et al., "Optimization of the Thick-and Thin-Film Technologies for Microwave Circuits on Alumina and Fused Silica Substrates", IEEE Transaction on Microwave Theory and Techniques, v. MTT-26, N. 10, (Oct. 1978), pp. 814-819.

Tang et al. "Cost Reduction Techniques for Phased Arrays", Microwave Journal, Jan. 1987, pp. 113-118.

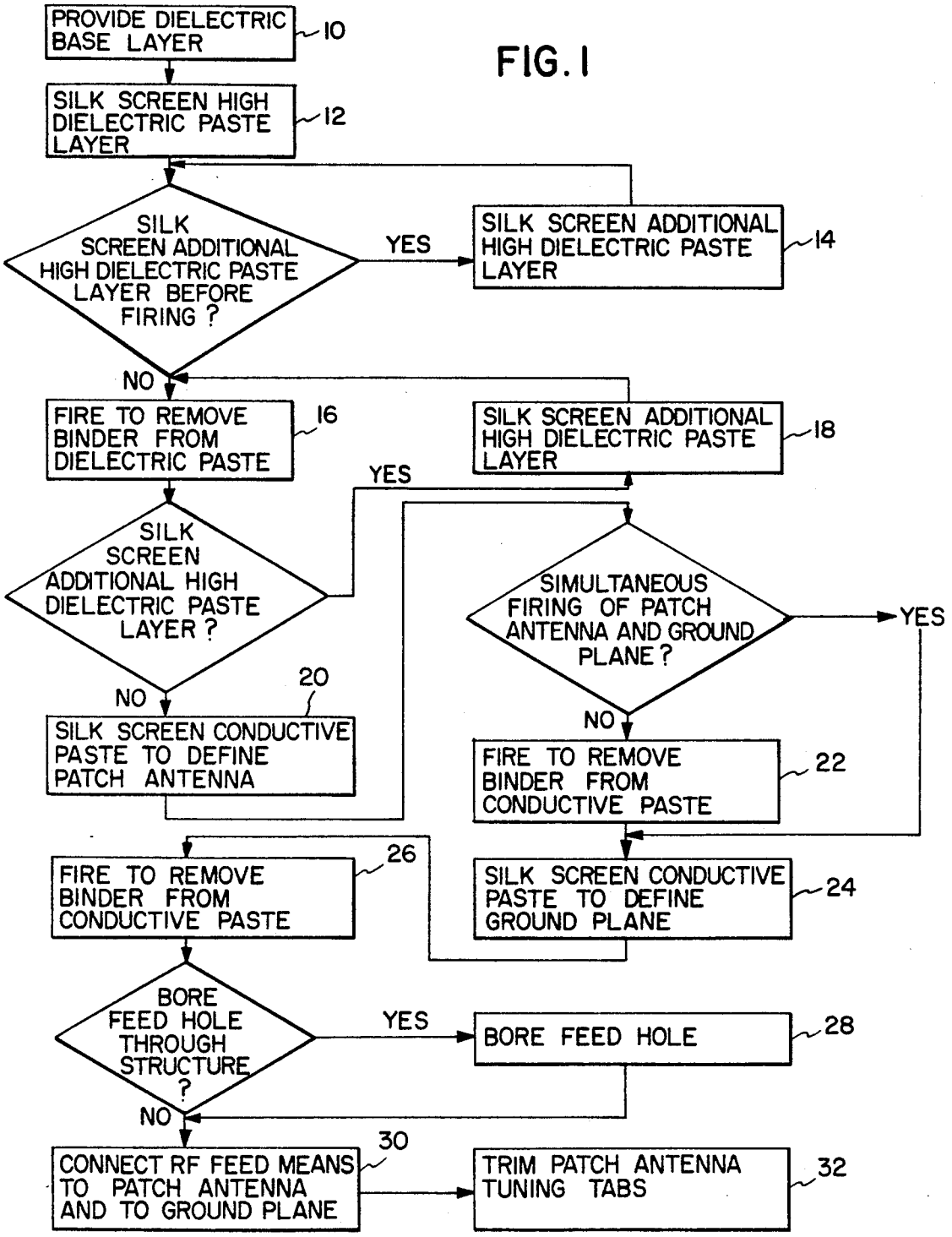
FIG. 1
PROVIDE DIELECTRIC BASE LAYER
10
SILK SCREEN HIGH DIELECTRIC PASTE LAYER
12
SILK SCREEN ADDITIONAL HIGH DIELECTRIC PASTE LAYER BEFORE FIRING ?
YES
SILK SCREEN ADDITIONAL HIGH DIELECTRIC PASTE LAYER
14
NO
FIRE TO REMOVE BINDER FROM DIELECTRIC PASTE
16
SILK SCREEN ADDITIONAL HIGH DIELECTRIC PASTE LAYER
18
YES
SILK SCREEN ADDITIONAL HIGH DIELECTRIC PASTE LAYER ?
SIMULTANEOUS FIRING OF PATCH ANTENNA AND GROUND PLANE ?
YES
NO
20
SILK SCREEN CONDUCTIVE PASTE TO DEFINE PATCH ANTENNA
NO
FIRE TO REMOVE BINDER FROM CONDUCTIVE PASTE
22
FIRE TO REMOVE BINDER FROM CONDUCTIVE PASTE
26
SILK SCREEN CONDUCTIVE PASTE TO DEFINE GROUND PLANE
24
BORE FEED HOLE THROUGH STRUCTURE ?
YES
BORE FEED HOLE
28
NO
CONNECT RF FEED MEANS TO PATCH ANTENNA AND TO GROUND PLANE
30
TRIM PATCH ANTENNA TUNING TABS
32

METHOD OF MANUFACTURE OF HIGH DIELECTRIC ANTENNA STRUCTURE

RELATED APPLICATIONS

This application is a continuation in part of application Ser. No. 07/799,264, having a filing date of Nov. 27, 1991, which is a continuation of application Ser. No. 07/551,206, having a filing date of Jul. 11, 1990, both of which applications are hereby incorporated by reference.

FIELD OF THE INVENTION

This invention is directed to a method of manufacture of high dielectric antenna structures, and more particularly, the manufacture of small, reduced cost single and multiple frequency patch antennas having a dielectric support structure with a relatively high dielectric constant.

BACKGROUND OF THE INVENTION

The uses for antennas continue to increase with reductions in antenna size and cost, and the development of complimentary microwave designs. For size reduction, "patch" antennas are of particular interest.

Patch antennas generally comprise a dielectric substrate, an electrically conductive ground layer disposed below the dielectric substrate, and an electrically conductive patch antenna element disposed over the dielectric substrate. The patch antenna element may be coupled to an RF feed means using any of several conventional methods such as a coaxial cable. A multiple frequency antenna may be constructed by "stacking" patch elements with intermediate dielectric layers.

Traditionally, efforts have been made to utilize dielectric materials having dielectric constants as close as possible to that of the free space into which the antenna radiates (e.g. approximately $K=1.0$ for air). Dielectric materials used in thin-film patch antennas have typically had a relatively low dielectric constant (e.g. approximately $K=2$ to 3), as is the case where a Teflon-fiberglass composite substrate is used. More recently, ceramic substrates having a dielectric constant of about 9 to 10 have been proposed for patch antennas in order to achieve size reduction.

For many expanding antenna applications, reception and transmission of high frequency signals is required. A primary example of growing importance is Global Positioning System (GPS) receivers. Such receivers are used, for example, in surveying and navigation applications. GPS receivers typically operate in the L1 and/or L2 bands, which are centered on approximately 1.575 GHz and 1.227 GHz, respectively, and preferably exhibit low-angle gain characteristics. Given the inherently mobile nature of many GPS antenna applications, reduced antenna size is desirable. Such size reduction is particularly useful in cases where GPS receivers are hand carried.

A mobile GPS transceiver is potentially capable of accessing, via satellite transmission, most data that is presently carried by fixed lines. Sufficient cost reduction can ultimately yield widespread use of mobile GPS transceivers and data access. Further, such cost reduction will allow for mobile communications between remote locations not served by fixed line transmission networks, including for example, communications within a fleet of mobile units.

Cost reduction may be achieved by reducing material and production costs. A reduction in antenna size correspondingly reduces material requirements. In patch antennas, the size of the antenna patch element may be reduced by increasing the dielectric constant of the dielectric which separates the antenna patch element from the ground plane. However, in order to accomplish simultaneous size and cost reduction, the higher dielectric constant must be achieved though use of materials and production methodology that does not disproportionately increase overall costs.

SUMMARY OF THE INVENTION

Accordingly, a primary objective of the present invention is to provide a cost-effective method for manufacturing relatively small antennas.

A further objective of the invention is to provide a cost effective method of manufacturing an antenna that yields a dielectric structure comprising relatively low cost components.

A further objective of the present invention is to provide a method of manufacturing a patch antenna of small size, wherein size reduction is achieved by use of a dielectric structure having a relatively high dielectric constant.

Another objective of the present invention is to provide a method of manufacturing a cost-effective patch antenna capable of high-frequency broadband, low-angle gain operation suitable for GPS and similar applications, and having a reduced size.

Another objective of the present invention is to provide a method of manufacturing a cost-effective patch antenna capable of multiple frequency operations, such as for dual frequency GPS applications in the $L_1$ and $L_2$ bands.

In accordance with the present invention, a method for manufacturing an antenna is disclosed wherein a multi-layered dielectric structure is fabricated utilizing dielectric components having different dielectric constants. The dielectric structure is formed by applying at least one high dielectric film layer to a supporting dielectric base layer, wherein the film layer yields a greater dielectric constant than that of the base layer alone. The base dielectric layer is preferably rigid for structural integrity, and to reduce size and control cost, preferably comprises a readily available ceramic substrate.

For further production cost control, silk screening is advantageously employed to apply the high dielectric film layer(s), although other film technologies may prove satisfactory. After application of the high dielectric paste, the dielectric structure is fired to remove the binder, resulting in a dielectric structure which preferably has an overall dielectric constant greater than approximately 20. Such a dielectric structure allows for significant size and cost reduction relative to known antennas.

As noted, multiple high dielectric film layers may be applied in fabricating the dielectric structure. These film layers may be successively applied to the structure. The layers may be applied to either side of the base dielectric layer, as well as to previously applied layers, and when silk screened, may be fired either after each successive layer is applied or after a plurality of layers have been applied. In the latter case, it is preferable to allow each layer to at least partially dry before applying another layer.

After a first dielectric structure is formed, an antenna element, preferably a patch antenna element, is positioned above the dielectric structure, a ground plane is provided below the dielectric structure and the patch antenna element is interconnected to RF feed means. Preferably, the patch antenna element and ground plane are each silk screened directly on to the dielectric structure. Such silk-screening allows the patch antenna element to be applied in a predetermined configuration appropriate for the intended feed techniques and desired signal characteristics (e.g., orthogonal feed on or near a diagonal axis of a $\lambda/2$ patch for a circularly polarized signal). The patch antenna element preferably includes peripheral tuning tabs which can be trimmed for fine tuning.

To employ stacked patch antenna elements (e.g. for multiple frequency applications), additional dielectric base/film layer(s) structures may be interposed between additional patch antenna elements, each dielectric structure preferably constructed in the manner aforesaid and yielding a common effective dielectric constant. Each patch antenna element may also be beneficially silk screened on its corresponding dielectric structure. In stacked arrangements, spacing means such as glass beads of a known diameter may be utilized in the bonding agent employed to adjoin adjacent dielectric structures, thereby allowing for enhanced parallel disposition of patch elements and the ground plane.

It should be appreciated that by silk-screening the dielectric film layer(s), antenna patch element(s) and ground plane, a substantially additive-only and highly reliable production process is provided, thereby yielding reduced costs. To yield batch production efficiencies, the base dielectric layer(s) may be pre-drilled, and the dielectric film layer(s), patch antenna element(s) and ground plane may be silk screened with openings defined in substantial vertical registration with the pre-drilled hole(s) in the base layer(s) to readily accommodate RF feed means (e.g., the center conductor of coaxial cable) access to and electrical connection with the top patch antenna element so as to yield the desired signal characteristics (e.g., feed on or near a diagonal of $\lambda/2$ patch for a circularly polarized signal). Alternatively, preferably, the antenna structure may be drilled during or after construction to provide RF feed means access to the top patch antenna element.

In one embodiment, a single frequency patch antenna may be manufactured for GPS applications. A rigid ceramic substrate having a dielectric constant of to at least about 9 comprises the base dielectric layer. A high dielectric paste, comprising a binder material and a high dielectric material such as titanium dioxide (e.g., having a dielectric constant of approximately 80), is then silk-screened onto the base layer and the dielectric structure is fired to remove the binder. Such steps may be repeated for additional dielectric film layers as noted above. A conductive paste comprising a metal and a binder is then silk-screened on to the top side of the dielectric structure in a predetermined patch antenna configuration having peripheral tuning tabs. The resulting structure is fired to remove the binder. A conductive paste comprising a metal and a binder is also silk-screened on the bottom side of the dielectric structure and fired to remove the binder. The antenna patch element and the ground plane are then electrically interconnected to RF feed means. For example, the patch element may be fed by passing the center conductor of a coaxial cable through a feed hole in the ground plane and overlying structure and electrically connecting the center conductor to the top patch element. The ground plane is directly connected to the outer conductor of the coaxial cable.

BRIEF DESCRIPTION OF THE DRAWINGS

For a more complete understanding of the present invention and the advantages thereof, reference will be made in the following description to the accompanying drawings, in which:

FIG. 1 is a flow chart for the manufacture of a single frequency antenna according to a GPS embodiment of the present invention;

DETAILED DESCRIPTION

Figure 2:
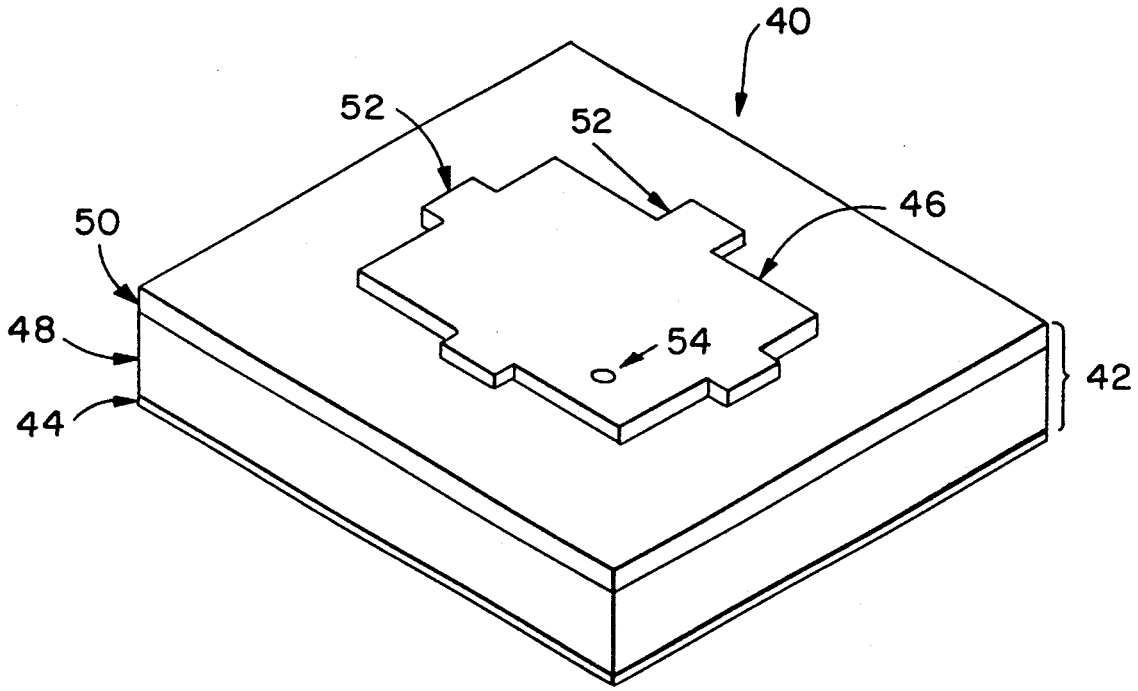
FIG. 2 illustrates a single frequency GPS antenna manufactured according to the present invention.

FIG. 1 is a flow chart for the production of a single frequency antenna according to a GPS embodiment of the present invention. First, a dielectric base layer is provided 10, which base layer serves as the foundation for construction of a dielectric structure. Preferably, the dielectric base layer is a readily-available, substantially rigid ceramic substrate (e.g., comprising approximately 96 percent alumina), having a dielectric constant of at least about 9.

A high dielectric film layer is silk-screened onto the dielectric base layer 12 and fired 16 to yield an effective dielectric structure having a dielectric constant greater than that of the base dielectric layer. The silk-screened high dielectric paste may, for example, comprise an epoxy binder and a high dielectric material such as titanium dioxide (having a dielectric constant of approximately 80), so that the resultant dielectric constant of the dielectric structure is at least approximately 20 after firing. The high dielectric paste is applied evenly to the top surface of the dielectric base layer, and preferably has a thickness of at least about 0.0005 inch, and more preferably between about 0.0005 and 0.0015 inch with a preferred nominal thickness of about 0.001 inch. If a single dielectric film layer does not yield the desired effective dielectric constant or overall dielectric structure thickness, one or more additional dielectric film layer(s) may be applied thereupon and/or to the opposite side of the base dielectric layer 14,18. Such additional layers may be applied with interim partial drying and collective firing 14,16 and/or may be applied and separately fired 14,16,18.

If the dielectric base layer has a pre-drilled feed hole, as desirable for batch substrate production efficiencies, an opening through each high dielectric film layer may be advantageously defined by the silk-screening steps 12,14,18, in substantial vertical registration with the pre-drilled feed hole. The feed hole provides interconnect access for the RF feed means as will be further discussed.

A conductive paste is then silk screened on the top surface of the dielectric structure in a desired predetermined antenna patch configuration 20, preferably including tuning tabs for impedance notching and/or resonance and polarization tuning. The structure may then be tuned 22 to remove the binder from the conductive paste. If the dielectric base layer employed has a pre-drilled feed hole, an opening through the antenna patch may be defined by the silk-screening step 20, substantially vertically registered on the pre-drilled feed hole. A conductive paste is similarly silk-screened onto the opposite side of the dielectric structure to yield a ground plane 24 and fired 26. Again, if the dielectric base layer employed has a pre-drilled feed hole, an opening through the ground plane may be defined by the silk screening step 24, substantially vertically registered on the pre-drilled feed hole. While either the antenna patch or ground plane can be silk screened and fired before silk screening and firing the other, firing both simultaneously 26 reduces production steps. The conductive paste for the antenna patch and ground plane may contain one of several metals, including, for example, copper, silver, gold, platinum-silver and palladium-silver. The layer of conductive paste for both the antenna patch element and ground plane preferably has a thickness of at least about 0.0005 inch and more preferably between about 0.0005 and 0.0015 inch with a preferred nominal thickness of about 0.001 inch.

After the patch antenna element and ground plane have been provided, an RF feed means hole may be bored through the structure 28 if necessary. An RF feed means is then interconnected to the antenna structure 30. For example, the center conductor of a coaxial cable may be passed through the feed hole and soldered to the top of the antenna patch, and the outer ground conductor of the cable may be soldered to the ground plane. Finally, peripheral tuning tabs provided on the antenna patch may be trimmed for impedance resonance and polarization tuning purposes 32.

It should be appreciated that the above-described method of manufacture is substantially additive-only by virtue of the use of silk-screening to apply the high dielectric film layer(s), antenna patch element and ground plane. Consequently, production costs are reduced. Further, the utilization of silk-screening allows for precise positioning of the antenna patch element relative to a pre-drilled feed hole, as well as the definition of corresponding vertically-registered openings in the other silk-screened layers, as may be desirable to yield the desired antenna performance on a highly-repeatable production basis. For example, by employing the disclosed process, a $\lambda/2$ patch antenna element may be fed on or near its diagonal axis via a pre-drilled feed hole and corresponding openings through the antenna structure, so as to transmit/receive circularly polarized signals with an acceptable impedance match.

While the foregoing description is directed to a method of manufacture of a single frequency antenna for a GPS embodiment, the method could easily be extended to the manufacture of multiple-frequency antennas. In such applications, additional dielectric structures and corresponding patch antenna elements could be successively manufactured in the manner aforesaid, with RF feed means being electrically interconnected with the uppermost patch antenna element.

FIG. 2 illustrates a single frequency antenna 40 produced by the method of the present invention. A dielectric structure 42 has a ground plane 44 disposed on one surface and a thick-film patch element 46 disposed on the other surface. The dielectric structure 42 comprises a ceramic substrate 48 and a high dielectric film layer 50 disposed thereupon.

Cost reduction is achieved through the use of a readily available ceramic substrate 48, such as a 96% alumina content substrate in an "as fired" condition, having a dielectric constant of at least about 9, and which does not require extensive pretreatment (e.g., polishing) when used in accordance with the present invention. The high dielectric film layer 50 results from one or more silk-screened applications of a high dielectric paste and firing.

Preferably, patch element 46 includes one or more tuning tabs 52 around its perimeter. Tuning tabs 52 may be trimmed to alter the geometry of patch element 46 to adjust the resonant frequency, impedance and/or polarization of the antenna after patch element 46 has been silk screened on to the dielectric structure 42.

As noted, a single coaxial cable (not shown) may be used to carry signals to and from the antenna. The center feed conductor of the coaxial connector is passed through a feed hole 54 in the ground plane 44 and openings through dielectric structure 42 and patch element 46, and soldered to patch element 46. The outer ground conductor of the coaxial cable is soldered to the bottom of ground plane 44. This type of connection permits packaging of transreceiver electronics below the antenna structure 40.

Figure 3:
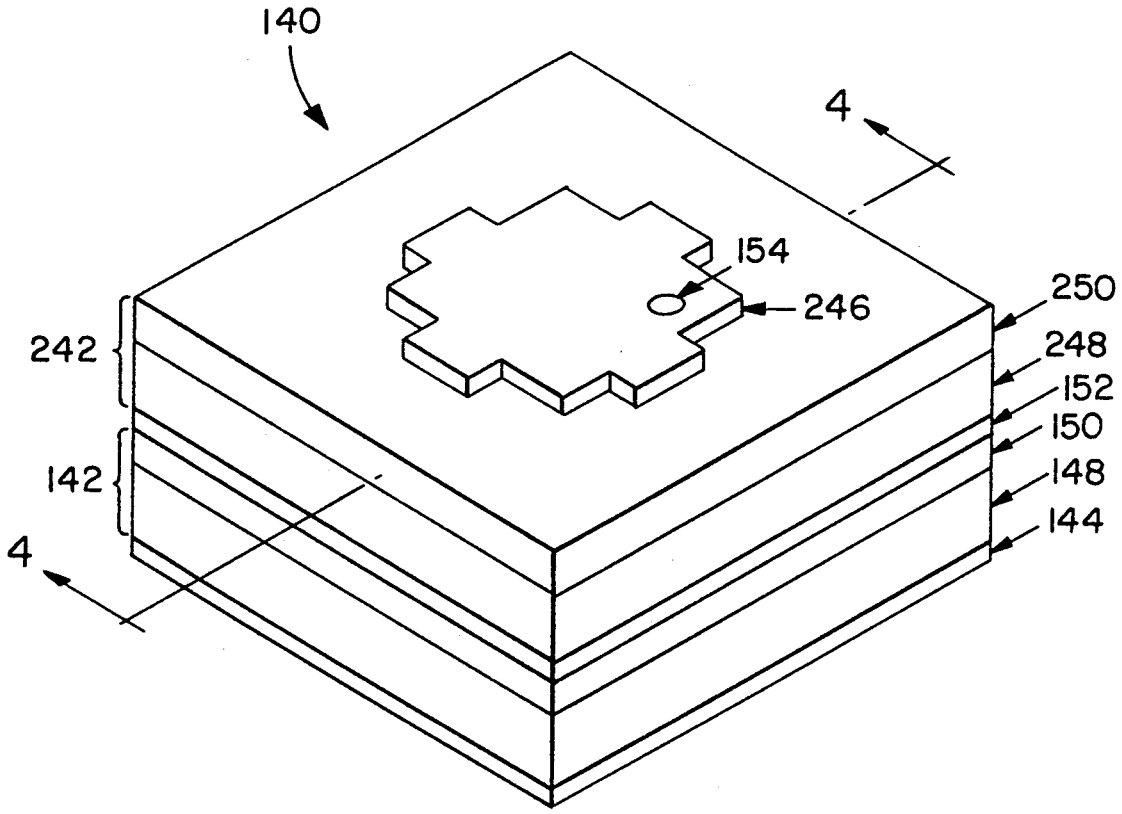
FIG. 3 illustrates a dual frequency GPS antenna manufactured according to the present invention.
Figure 4:
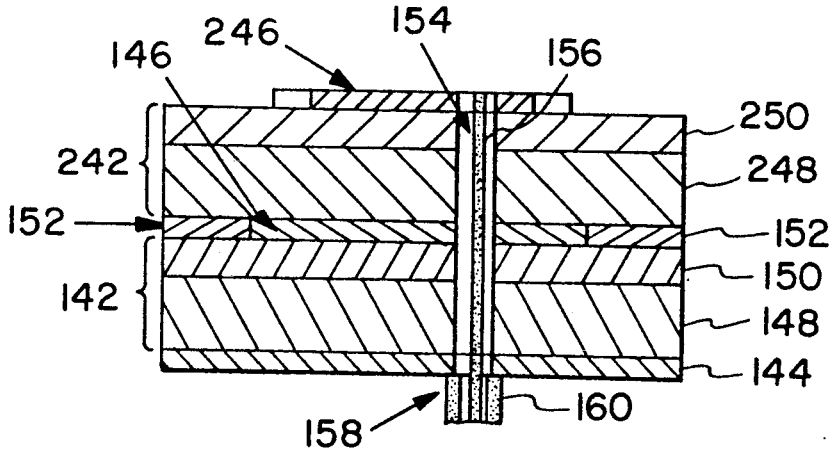
FIG. 4 illustrates a cross section of the dual frequency GPS antenna depicted in FIG. 3.

FIGS. 3 and 4 illustrate a dual frequency antenna 140 produced according to the method of the present invention. A first dielectric structure 142 separates a ground plane 144 from a first patch element 146. The first dielectric structure 142 includes a dielectric base layer 148 and a dielectric film layer 150 defined by one or more silk-screened applications of a high dielectric paste. A second dielectric structure 242 separates first patch element 146 from a second patch element 246. The second dielectric structure also includes a dielectric base layer 248 and a dielectric film layer 250 defined by one or more silk-screened applications of a high dielectric paste. The dielectric film layers 150 and 250 have higher dielectric constants than the dielectric base layers 148 and 248. The dielectric structures 142 and 242 should preferably have substantially common dielectric constants and should be provided to dispose first patch element 146, second patch element 246 and ground plane 144 in a substantially parallel relationship.

The second dielectric structure 242 is affixed to the first dielectric structure 142 by a bonding agent layer 152 which preferably has a dielectric constant that matches the dielectric constant of the dielectric structures 142,242, (e.g., a titanium oxide-loaded adhesive). The thickness of the layer of the bonding agent 152 may be controlled by the addition of spacing means, such as glass beads of a known diameter. Such spacing means may be used to establish a substantially uniform thickness and planar top surface, thus contributing to the parallel disposition of the antenna elements 146, 246 and ground plane 144. When spacing means are employed, slight pressure is applied to the bonding agent in the course of application to insure substantial contact between the spacing means and first and second dielectric structures 142,242.

A feed hole 154 through ground plane 144, dielectric structures 142 and 242 and patch elements 146 and 246 provides an access through which a center conductor 156 of a coaxial cable 158 can be coupled to second patch element 246 (e.g., by soldering). Center conductor 156 does not contact ground plane 144 or first patch element 146. The outer ground conductor sheath 160 of coaxial cable 158 is coupled to ground plane 144 (e.g., by soldering).

In operation, first and second patch elements 146 and 246 are electromagnetically coupled when second patch element 246 is properly driven via RF feed means 158.

That is, each patch element 146 and 246 is designed to operate at a particular resonant frequency, first element 146 having the lower resonant frequency because of its larger size. At the resonant frequency of first patch element 146, second patch element 246 is operating below its resonant frequency and is electromagnetically coupled to first patch element 146. A transmit radiation signal is thus excited between first patch element 146 and ground plane 144. At the higher resonant frequency of second patch element 246, first patch element 146 is capacitively coupled to ground plane 144 and a transmit radiation signal is excited between second patch element 246 and first patch element 146. Consequently, it can be appreciated that antenna structure 140 is operable to radiate or receive signals at two frequencies which are determined by the dimensions of first and second patch elements 146 and 246, respectively.

As will be appreciated, antennas which are operable at more than two resonant frequencies may be constructed by stacking additional dielectric layers and patch elements onto the antenna structure. The top most patch element would be directly coupled to inner connector 156 while the lower patch elements would be electromagnetically coupled in the manner previously noted.

Although the present invention has been described in detail, it should be understood that various changes, substitutions and alterations can be made hereto without departing from the scope of the invention as defined by the appended claims.

What is claimed is:

1. A method for manufacturing an antenna structure, comprising the steps of:

providing a first dielectric base layer having a first dielectric constant silk-screening at least a first dielectric film layer on said first dielectric base layer to form a first dielectric structure, wherein said at least first dielectric film layer has a second dielectric constant that is greater than said first dielectric constant;

positioning a first patch antenna element on said first dielectric structure;

supplying a ground plane below said first dielectric structure; and interconnecting RF feed means to the first antenna patch element and to the ground plane.

2. The process of claim 1, wherein said silk-screening step includes:

successively silk-screening a plurality of dielectric film layers to said first dielectric structure, wherein each of said plurality of layers has a dielectric constant that is greater than said first dielectric constant.

3. The process of claim 1, wherein said first dielectric film layer has a thickness of at least about 0.0005 inch.

4. The process of claim wherein said first dielectric structure has a dielectric constant of at least about 20.

5. The method of claim 1, wherein said providing step includes:

selecting a substantially rigid substrate.

6. The method of claim 5, wherein said providing step includes:

selecting a ceramic substrate having an alumina content of about 96 percent.

7. The method of claim 6, wherein said providing step includes:

selecting a ceramic substrate having a dielectric constant of at least about 9.

8. The method of claim 1, wherein said positioning step includes:

silk-screening said first patch antenna element on a top surface of the first dielectric structure in a predetermined configuration and a predetermined thickness.

9. The method of claim 8, wherein the predetermined thickness is at least about 0.0005 inch.

10. The method of claim 1, wherein said first dielectric base layer has a feed hole, and said positioning step includes:

silk-screening said first patch antenna element on a top surface of the first dielectric structure in a predetermined configuration and in a predetermined location relative to said feed hole.

11. The method of claim 1, wherein said supplying step includes:

silk-screening said ground plane on a bottom surface of the first dielectric structure to a predetermined thickness.

12. The method of claim 11, wherein the predetermined thickness is at least about 0.0005 inch.

13. The method of claim 1, wherein:

said first dielectric base layer has a feed hole; and said positioning step includes:

silk-screening said first patch antenna element on a top surface of the first dielectric structure in a predetermined configuration and in a predetermined location relative to said feed hole, with a feed opening being contemporaneously defined through the first patch antenna element in substantial vertical registration with said feed hole;

said silk-screening of said at least first dielectric film layer includes:

contemporaneously defining a feed opening through said at least first dielectric film layer in substantial vertical registration with said feed hole; and said supplying step includes:

silk-screening said ground plane on a bottom surface of the first dielectric structure, with a feed opening being contemporaneously defined through said ground plane in substantial vertical registration wit said feed hole.

14. The method of claim 1, further including:

defining a feed hole through said first dielectric structure, patch antenna element and ground plane; and wherein said RF feed means comprises a coaxial cable having a center feed conductor and an outer ground conductor, and said interconnecting step includes:

passing one end of said center feed conductor through the feed hole;

electrically connecting one end of the center feed conductor to the antenna patch element; and electrically connecting one end of the outer ground conductor to the ground plane.

15. The method of claim 14, wherein said positioning step and said defining step includes:

locating said feed hole and first patch antenna element in a predetermined relative arrangement for transmission/reception of circularly polarized signals.

16. The method of claim 1, comprising the additional steps of:

providing a second dielectric base layer having a third dielectric constant;

silk-screening at least a first dielectric film layer on said second dielectric base layer to form a second dielectric structure, wherein said at least first dielectric film layer on said second dielectric base layer has a fourth dielectric constant that is greater than said third dielectric constant;

positioning a second patch antenna element on said second dielectric structure; and, locating said second patch antenna element and said second dielectric structure between said ground plane and said first dielectric structure.

17. The method of claim 16, said locating step including:

providing a bonding layer between said first dielectric structure and said second dielectric structure and said second dielectric structure, said bonding layer comprising spacing means having a substantially uniform maximum thickness; and applying pressure to said bonding layer, wherein said spacing means contact both said first dielectric structure and second dielectric structure.

18. A method for manufacturing an antenna structure, comprising the steps of:

providing a substantially rigid dielectric substrate;

silk-screening one or more dielectric film layers on said dielectric substrate to form a dielectric structure, said dielectric structure having a dielectric constant greater than that of the dielectric substrate;

silk-screening a patch antenna element on a top side of said dielectric structure in a predetermined configuration;

silk-screening a ground plane on a bottom side of said dielectric structure;

interconnecting feed means to the antenna patch element and to the ground plane.

19. The method of claim 18, wherein said dielectric structure has a dielectric constant of at least about 20.

* * * * *